United States Patent [19]

Marks

[11] Patent Number: 4,551,238

[45] Date of Patent: Nov. 5, 1985

[54] METHOD AND APPARATUS FOR PRESSURE-CASCADE SEPARATION AND STABILIZATION OF MIXED PHASE HYDROCARBONACEOUS PRODUCTS

[75] Inventor: Charles E. Marks, Princeton, N.J.

[73] Assignee: Mobil Oil Corporation, New York, N.Y.

[21] Appl. No.: 668,788

[22] Filed: Nov. 6, 1984

[51] Int. Cl.[4] ..... C10G 49/22

[52] U.S. Cl. ..... 208/340; 208/100; 208/212; 208/102

[58] Field of Search ..... 208/100, 102, 212, 95, 208/340

[56] References Cited

U.S. PATENT DOCUMENTS

| | | | |
|---|---|---|---|
| 3,054,745 | 9/1962 | Forbes et al. | 208/100 |
| 3,296,118 | 1/1967 | Czajkowski et al. | 208/100 |
| 3,607,726 | 9/1971 | Hallman | 208/102 |
| 3,649,519 | 3/1972 | Watkins | 208/100 |
| 3,847,799 | 11/1974 | Munro | 208/212 |
| 3,996,129 | 12/1976 | Weith | 208/102 |
| 4,367,135 | 1/1983 | Posey, Jr. | 208/102 |
| 4,457,834 | 7/1984 | Caspers et al. | 208/102 |

*Primary Examiner*—D. E. Gantz
*Assistant Examiner*—Anthony McFarlane
*Attorney, Agent, or Firm*—Alexander J. McKillop; Michael G. Gilman; Dennis P. Santini

[57] ABSTRACT

Disclosed is a method and apparatus for separating and stabilizing a hydrotreater effluent into a stabilized liquid product and a dry gas product. The hydrotreater effluent is expanded in a first expansion drum from a high pressure to an intermediate pressure, evolving both gaseous and liquid phase components. The gaseous phase components are withdrawn as the gas product and the liquid phase components are further processed. The liquid phase components are further expanded in a second expansion drum, evolving further gas products which are compressed, cooled and returned to the first expansion drum. The second expansion drum liquid phase can comprise the liquid product output or can be further treated by an additional expansion stage.

4 Claims, 3 Drawing Figures

METHOD AND APPARATUS FOR PRESSURE-CASCADE SEPARATION AND STABILIZATION OF MIXED PHASE HYDROCARBONACEOUS PRODUCTS

BACKGROUND OF THE INVENTION

1. Field of the Invention

The present invention generally relates to the field of hydrocarbon conversion processes and specifically relates to a method and apparatus for separation and stabilization of products of a hydrogen-consuming hydrocarbon conversion process.

2. Discussion of the Prior Art

The process of "hydrocracking" has been generally known as a hydrogen-consuming conversion process for the refining of kerosene fractions, middle-distillate fractions, light and heavy vacuum gas oils, light and heavy cycle stocks, etc. for the primary purpose of reducing the concentration of various contaminating influences contained therein.

More recently, petroleum technology has turned towards the hydrocracking of residual stocks, such as tower bottoms products, crude products, topped crude oils, crude oils extracted from tar sands, shale oil, etc. Common among all such products is the addition of hydrogen to the oil feed and its passage through a reactor, with subsequent washing and high pressure low temperature separation. Such a process is schematically illustrated in FIG. 1, in which oil feed 10 and reactant gas 12 feed reactor 14, where the hydrocarbon conversion process takes place. The reactant gas 12 comprises recycle gas 16 (mostly hydrogen) and hydrogen makeup gas 18. The output of reactor 14 is a converted hydrocarbon oil with excess hydrogen gas, ammonia and hydrogen sulfide gases dissolved therein. Wash water 20 is added to the output of reactor 14 in order to separate the ammonia and hydrogen sulfide gases from the oil. A low temperature high pressure separator 22 is utilized to separate the oil from the water containing dissolved ammonia and hydrogen sulfide and further to separate any excess hydrogen gas contained in the mixture. This excess gas 24 is supplied to a compressor 26 powered by a power source 28. Compressor 26 compresses the excess gas 24, such that it can be added in the form of recycled gas 16 to the reactor 14. If desirable, a gas bleed 30 can be provided for removing a portion of excess gas 24.

Typical temperatures and pressures in the low temperature separator are on the order of 110° F. and 2450 psia. The excess gas 24 comprises on the order of 80 plus volume percent hydrogen, with the remainder comprising ammonia, hydrogen sulfide, and hydrocarbons.

The oil product 32, from the low temperature separator 22, must then have its gas component removed from the syncrude component, so that the vapor pressure of the liquid syncrude is low enough to enable it to be stored and/or shipped. At the same time, the gaseous component of product 32 must be sufficiently rectified so that it can be used as fuel gas.

FIG. 2 illustrates a typical separation and stabilization system for the processing of the hydrotreated effluent 32 from FIG. 1. The hydrotreated effluent 32 supplied at high pressure is flashed to a lower pressure in low pressure separator 34, with a gaseous phase output 36 being transmitted directly to absorber 38. The liquid phase output 40, from low pressure separator 34, is transmitted to stripper tower 42, whereupon gaseous products are further removed from the liquid phase. Gaseous products from the stripper tower 42 are condensed in air fin cooler 44 conducted into a surge tank 46 and then fed back to stripper tower 42 and/or to absorber 38. The liquid phase output 45 leaving stripper tower 42 has a portion which is heated in reboiler 48 and then resubmitted to the stripper tower in order to boil off any remaining gases contained in the stripper tower 42 liquid phase output.

The absorber 38, accepting gaseous phase output 36 from the low pressure separator 34 and liquid phase output 47 from stripper tower 42, also receives liquid phase output 50 from liquid cooled heat exchanger 52. A portion of liquid phase output 54 from absorber 38 is passed through reboiler 51 to enhance separation of any further dissolved gases in the liquid phase output 54. All gases supplied to or evolved in absorber 38 pass into gas output conduit 56. The liquid phase output 54 of absorber 38, which is not recirculated through reboiler 51 passes to debutanizer 58.

The gaseous phase output 60, from debutanizer 58, passes through an air fin cooler 61 and into surge tank 63. Gas from the surge tank 63 is supplied directly to gas output conduit 56 and liquid from the surge tank is reintroduced into the debutanizer 58. A portion of the liquid phase output 62, from the debutanizer 58, is passed through reboiler 57 and reintroduced into debutanizer 58 to further separate gas from the liquid phase output 62.

A portion of the liquid phase output 62 which is not recirculated, passes into lean oil still 64. In lean oil still 64 the gaseous output phase 66 is circulated through an air fin cooler 65 and into a surge tank 69. The liquid phase output 68 from the lean oil still surge tank 69 is supplied directly to the syncrude output line 49. The liquid phase output 70 from the lean oil still surge tank 69 is resubmitted to the lean oil still 64. A portion of the liquid phase output 72 is recirculated through reboiler 74 back into the lean oil still 64. The remainder of the liquid phase output 72 passes through air fin cooler 73 and a portion passes into the syncrude output line 49. However, a portion of liquid phase output 72 also passes through the liquid cooled heat exchanger 52, and from there passes as a liquid phase output into absorber 38.

Thus, it can be seen that a typical prior art hydrotreated oil separation and stabilizing system requires energy input in the form of at least four reboilers 48, 51, 57, 74, at least five coolers (air fin coolers 44, 61, 65, 73 and liquid cooled heat exchanger 52) and four separate towers 38, 42, 58, 64, in addition to a low pressure separator 34. It would be desirable to reduce the capital expenditure required of such prior art systems, while at the same time reducing the complexity of operation. It also would be further advantageous to eliminate, to the extent possible, the energy requirements of the reboilers, which may well be wasted energy, ultimately lost to the atmosphere. Thus, the conventional way of achieving product separation has been by means of a stripper tower, in some instances preceded by a low-pressure flash drum, plus a three-tower gas plant. Each of these four fractionating towers is heated by a reboiler, which might in some instances be stripping steam to the stripper tower, which also requires that the overheads or gaseous phase outputs be condensed and the products cooled at the output of the unit.

SUMMARY OF THE INVENTION

It is an object of the present invention to provide a method and apparatus for separating hydrotreated oil into both a stabilized syncrude product and a dry gas product without heating or fractionation.

It is a further object of the present invention to provide a method and apparatus for providing stabilized syncrude and dry gas products in a more economical manner.

It is a further object of the present invention to provide a method and apparatus for separating hydrotreated effluent into a stabilized liquid product and a dry gas product without the heat input necessary in conventional multi-tower gas plants.

The above and other objects are achieved in accordance with a method aspect of the present invention by the steps of: expanding a hydrotreated effluent from a high pressure to an intermediate pressure in a first expansion drum evolving both gaseous and liquid phase hydrocarbon components; drawing off said gaseous phase components as a gas product; expanding said liquid phase components from said intermediate pressure to a lower pressure evolving secondary gas and liquid phase hydrocarbon components; compressing, cooling and returning said secondary gas phase components to said first expansion drum; and withdrawing said secondary liquid phase hydrocarbon components as a separated and stabilized liquid hydrocarbon product.

The above and other objects are achieved in accordance with the present invention in its apparatus aspects by an apparatus comprising a first low temperature flash drum for expanding hydrotreated effluent from a high pressure to an intermediate pressure evolving both gas and liquid phase hydrocarbon components; means for drawing off said gas phase hydrocarbon components as a dry gas product; a second low temperature flash drum for expanding said liquid phase from said intermediate pressure to a lower pressure; means for conducting said liquid phase hydrocarbon component from said first drum to said second drum, said liquid phase hydrocarbon component evolving secondary gas and liquid phase hydrocarbon component in said second expansion drum; means for compressing, cooling and returning said secondary gas phase hydrocarbon components to said first expansion drum; and means for withdrawing said secondary liquid hydrocarbon component as a separated and stabilized hydrocarbon product.

The invention, in either its method or apparatus embodiments, can be configured as an original installation or as a retrofit to an existing hydrotreater system.

BRIEF DESCRIPTION OF THE DRAWINGS

A more complete appreciation of the invention, and many of the attendant advantages thereof, will be readily apparent as the same becomes better understood by reference to the accompanying drawings, wherein.

DETAILED DESCRIPTION OF THE PREFERRED EMBODIMENTS

Figure 1:
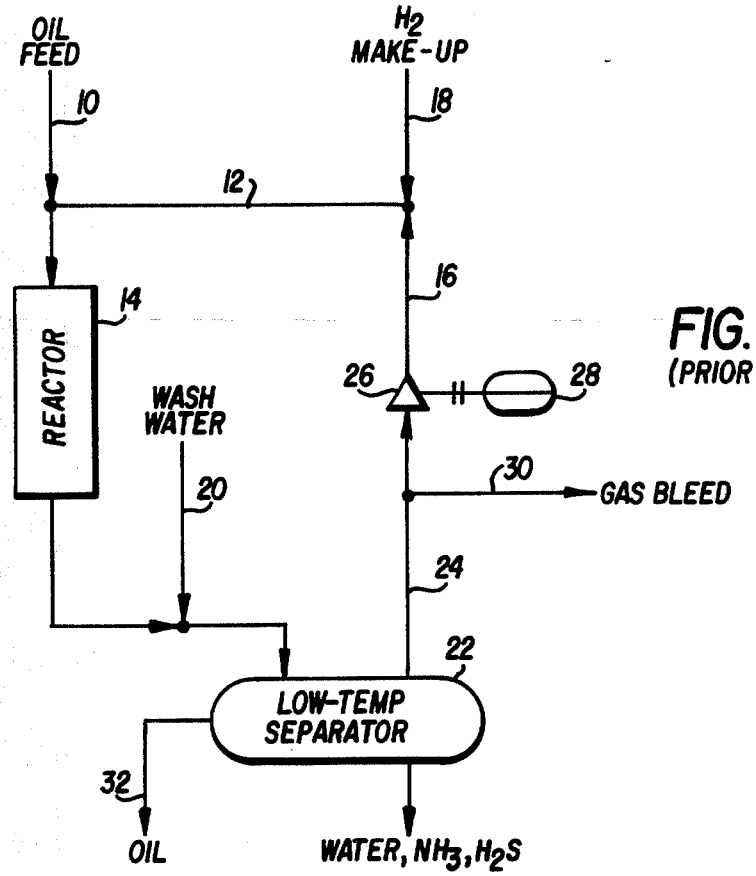
FIG. 1 (PRIOR ART)
FIG. 1 is a schematic diagram of a conventional prior art hydrotreater unit.
Figure 3:
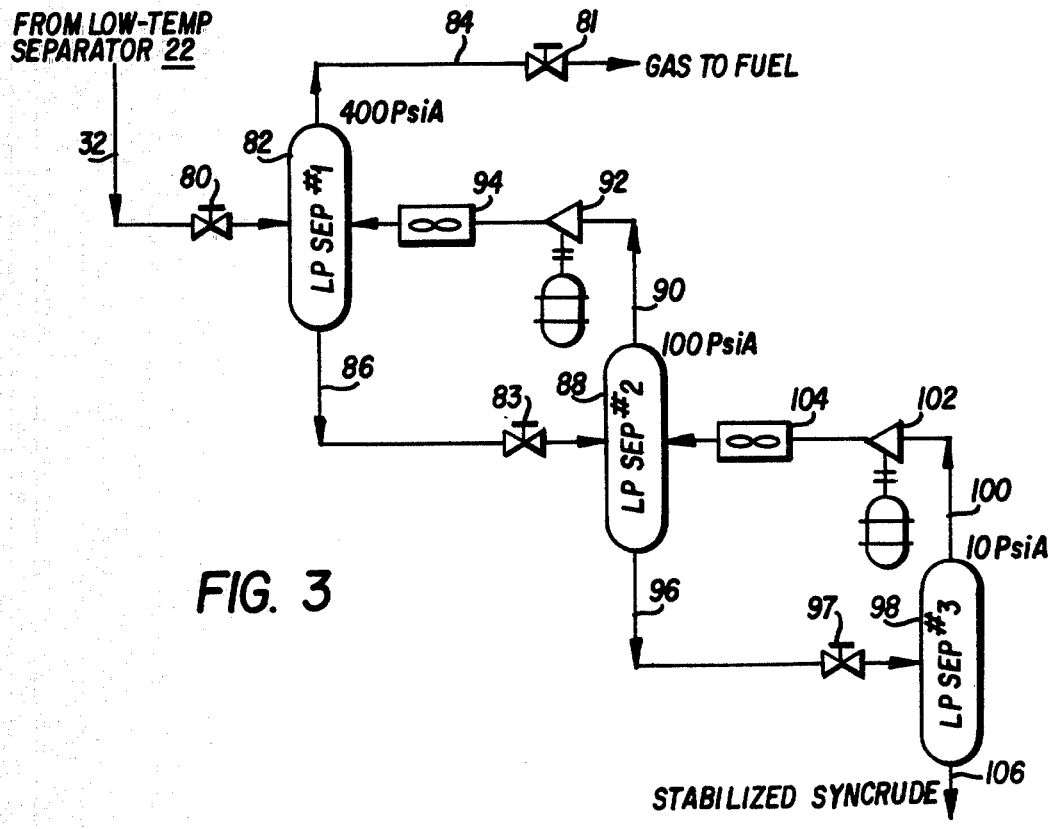
FIG. 3 is a schematic flow diagram of the present invention for separation of a hydrotreated effluent into a stabilized syncrude and dry gas product outputs.

Referring now to the drawings, where similar elements are similarly labeled, FIG. 3 illustrates that the hydrotreated effluent from the low-temperature separator 22 is supplied through control valve 80 to a first expansion drum 82. Because the hydrotreated effluent 32 is at a high pressure (on the order of 2450 psia) and the expansion drum is maintained at about 400 psia, gases contained in the hydrotreated effluent boil off and provide a gaseous phase output 84, which passes through a control valve 81 to the fuel gas system as a dry gas product. The dew point of the gas product is on the order of 45° F. at 75 psig (the maximum fuel gas system pressure). This gas can be distributed and used as fuel gas without further processing or treating. The liquid phase output 86 from the first expansion drum 82 is passed through another control valve 83 and into a second expansion drum 88. In the second expansion drum, the pressure is dropped from the substantially 400 psia in the first expansion drum to about 100 psia, resulting in some additional gas evolution and further phase separation. The second expansion drum gas phase output 90 is compressed in compressor 92, cooled in air fin cooler 94, and reintroduced into the first expansion drum 82.

The liquid phase output 96 of the second expansion drum 88 is supplied through control valve 97 to a third expansion drum 98. The pressure drops from 100 psia in the second expansion drum to about 10 psia in the third expansion drum, causing further evolution of any gas dissolved in the liquid phase output 96 which is supplied to the third expansion drum. Gaseous phase output 100 from the third expansion drum is compressed in compressor 102, cooled in air fin cooler 104 and resubmitted to the second expansion drum 88. The liquid phase output 106 from the third expansion drum is the stabilized syncrude, which is one of the desired final output products.

It should be noted that all of the expansion drums shown in FIG. 3 are maintained at relatively low temperatures, on the order of 100°–110° F. The pressure in the first expansion drum of about 400 psia can be adjusted, depending upon the quality of the "dry" gas product desired therefrom. The specific pressures in the present instance anticipates hydrotreated whole shale oil being received from the low temperature separator 22. Obviously, different materials may require slightly different pressures and/or temperatures to provide the desirable product. It is believed that the pressure in drum 82 should be within the range of from 200–800 pisa, in drum 88 from 50–200 psia, and in drum 98 from 0–50 psia. The pressure of the final drum is adjusted to give a storable, shippable syncrude and, in the present instance, an output pressure below atmospheric ensures that there will be no additional gas evolution during syncrude storage.

Figure 2:
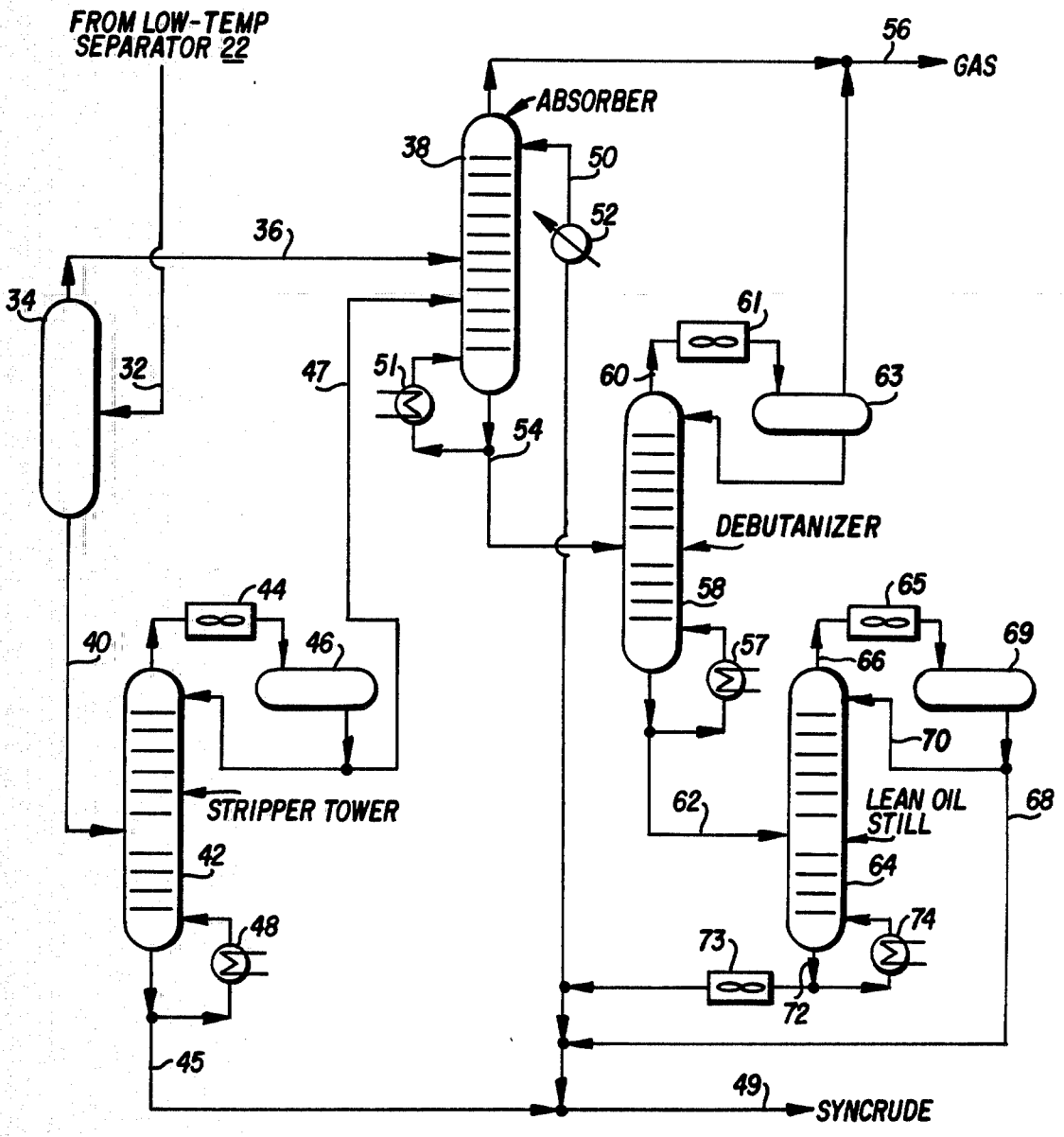
FIG. 2 (PRIOR ART)
FIG. 2 is a schematic flow diagram of a conventional prior art system for separating and stabilizing hydrotreated effluent into syncrude and dry gas product outputs.

Because the complexity of the above pressure-cascade system is quite reduced from that shown in FIG. 2 and typical of prior art hydrotreater effluent separation systems, the capital expenditure to construct such a system will be substantially less than that currently envisioned. Furthermore, the energy requirements for running compressors 92 and 102 comprise only 10–20% of the energy required by the reboilers in a conventional system, and thus the operating costs are substantially less for the pressure-cascade system. Without the compressors and their recycle capability, the dew point temperature of the resultant gas product 84 would be significantly higher. However, in some systems, this may be acceptable and one or more of the compressor recycle stages could be eliminated. Further, if the desired level of gas phase and liquid phase separation is not as high, two expansion drums could be utilized, rather than the three illustrated in FIG. 3.

One significant requirement of the present invention is that there be a substantially high pressure associated with the hydrotreated effluent. Although the present embodiment utilizes a pressure in the vicinity of 2450 psia, it is estimated that pressures as low as 800 psia would be sufficient to provide reasonable product and phase separation. As to the specific feedstock products supplied, the pressure-cascade will have the greatest utility where the effluent from the hydrotreater is a full range hydrogen-hydrocarbon mixture containing balanced amounts of gas, naphtha, distillate and heavy oil. Examples of such balanced mixtures are the outputs or effluents of hydrocrackers and whole shale oil hydrotreaters. It may be more advantageous to locate the pressure-cascade system in a field installation rather than in an oil refinery. In areas where the retorting and upgrading system is mounted on oil bearing shale, the reduction in the amount of equipment, as would occur in the use of the pressure-cascade instead of the FIG. 2 stabilization system, means more of the oil bearing shale resource can be recovered without mining under plant equipment.

As should be apparent from the above disclosure, many modifications and variations of the pressure-cascade system will be readily apparent to one of ordinary skill in the art. The specific sizes of interconnecting conduits, expansion drums, compressors, air fin coolers, etc. will depend upon a number of factors, among which are the specific hydrotreater effluent 32, the specific level of stabilization of syncrude which is acceptable, the quality of the gas product and the volume rate of flow of hydrotreater effluent into the system. In view of this disclosure, it will be obvious to one of ordinary skill that based upon the desired rate of flow and the product quality, the various pressure drops can be determined and then the desired compressors and coolers chosen. Therefore, the present invention is not limited by the above disclosure and is only limited by the scope of the claims appended hereto.

I claim:

1. A method for separating and stabilizing a hydrotreater effluent, comprising the steps of:

expanding the effluent from a high pressure to an intermediate pressure in a first expansion drum, resulting in both gaseous and liquid phase hydrocarbon components;

drawing off said gaseous phase hydrocarbon components as a gas product;

expanding said liquid phase hydrocarbon components from said intermediate pressure to a lower intermediate pressure in a second expansion drum, evolving secondary gaseous and liquid phase hydrocarbon components;

compressing and cooling said secondary gaseous phase hydrocarbon components and returning the cooled components to said first expansion drum; and withdrawing said secondary liquid phase hydrocarbon components.

2. The method according to claim 1, further comprising, after said withdrawing step, the steps of:

expanding said secondary liquid phase hydrocarbon components from said lower intermediate pressure to a lower pressure in a third expansion drum, evolving tertiary gaseous and liquid phase hydrocarbon components;

compressing and cooling said tertiary gaseous phase hydrocarbon components and returning the cooled components to said second expansion drum; and withdrawing said tertiary liquid phase hydrocarbon component as a separated stabilized hydrocarbon product.

3. The method according to claim 2, wherein said hydrotreater effluent comprises hydrotreated whole shale oil and said high pressure is above 800 psia, said intermediate pressure is within the range of from 200–800 psia, said lower intermediate pressure is within the range of from 50–200 psia and said lower pressure is within the range of from 0–50 psia.

4. The method according to claim 3, wherein said high pressure is about 2450 psia, said intermediate pressure is about 400 psia, said lower intermediate pressure is about 100 psia and said lower pressure is about 10 psia.

* * * * *